US009027485B2

(12) United States Patent
Taguchi et al.

(10) Patent No.: US 9,027,485 B2
(45) Date of Patent: May 12, 2015

(54) OBSTACLE DEFLECTOR OF RAILCAR

(75) Inventors: Makoto Taguchi, Akashi (JP); Atsushi Sano, Kakogawa (JP); Toshiyuki Yamada, Kobe (JP); Hideki Kumamoto, Akashi (JP); Seiichiro Yagi, Akashi (JP); Masayuki Tomizawa, Akashi (JP)

(73) Assignee: Kawasaki Jukogyo Kabushiki Kaisha, Kobe-Shi (JP)

( * ) Notice: Subject to any disclaimer, the term of this patent is extended or adjusted under 35 U.S.C. 154(b) by 154 days.

(21) Appl. No.: 13/988,429

(22) PCT Filed: Oct. 11, 2011

(86) PCT No.: PCT/JP2011/005675

§ 371 (c)(1),
(2), (4) Date: May 20, 2013

(87) PCT Pub. No.: WO2012/066719

PCT Pub. Date: May 24, 2012

(65) Prior Publication Data

US 2013/0239847 A1 Sep. 19, 2013

(30) Foreign Application Priority Data

Nov. 19, 2010 (JP) ..... 2010-258535

(51) Int. Cl.
*B61F 19/04* (2006.01)
*B61F 1/10* (2006.01)
(Continued)

(52) U.S. Cl.
CPC ..... *B61F 19/04* (2013.01); *B61D 15/06* (2013.01); *B61F 1/10* (2013.01); *B61D 17/06* (2013.01)

(58) Field of Classification Search
CPC ..... B61F 19/04; B61F 1/10; B61D 15/06; B61D 17/06
USPC ..... 105/173, 392.5, 394, 402, 421; 213/220, 221
See application file for complete search history.

(56) References Cited

U.S. PATENT DOCUMENTS 6,263,805 B1 * 7/2001 Taguchi et al. ..... 105/421
6,820,759 B1 * 11/2004 Schindler et al. ..... 213/221

(Continued)

FOREIGN PATENT DOCUMENTS

GB 679686 A 9/1952
JP A-2000-006806 1/2000

(Continued)

OTHER PUBLICATIONS

Jan. 17, 2012 International Search Report issued in International Patent Application No. PCT/JP2011/005675.

*Primary Examiner* — Zachary Kuhfuss
(74) *Attorney, Agent, or Firm* — Oliff PLC

(57) ABSTRACT

An obstacle deflector provided at a front portion of an underframe of a carbody of a railcar includes an obstacle deflecting plate configured to protect the carbody from an obstacle on a railway track when the railcar is traveling. The obstacle deflecting plate includes a main plate portion provided to receive the obstacle by a surface thereof and having a curved shape that is convex toward a front side in a traveling direction in plan view and a sub plate portion projecting toward a rear side from the main plate portion and is continuously provided along the main plate portion so as to extend from a convex, curved front end portion of the main plate portion toward a pair of left and right side portions of the main plate portion, the left and right side portions being located at the rear side in the traveling direction.

9 Claims, 9 Drawing Sheets

(51) Int. Cl.
*B61D 15/06* (2006.01)
*B61D 17/06* (2006.01)

(56) References Cited

U.S. PATENT DOCUMENTS

| | | | | |
|---|---|---|---|---|
| 6,889,617 | B2 * | 5/2005 | Taguchi | 105/392.5 |
| 6,951,176 | B2 * | 10/2005 | Taguchi | 105/392.5 |
| 7,694,633 | B2 * | 4/2010 | Mayer | 105/392.5 |
| 2008/0250965 | A1 | 10/2008 | Clark et al. | |
| 2010/0218701 | A1 * | 9/2010 | Graf et al. | 105/392.5 |
| 2012/0097066 | A1 * | 4/2012 | Matsuoka et al. | 105/342 |
| 2012/0325108 | A1 * | 12/2012 | Graf et al. | 105/392.5 |
| 2013/0233200 | A1 * | 9/2013 | Taguchi et al. | 105/392.5 |
| 2014/0290528 | A1 * | 10/2014 | Fan et al. | 105/392.5 |

FOREIGN PATENT DOCUMENTS

| | | |
|---|---|---|
| JP | A-2000-168551 | 6/2000 |
| JP | A-2005-53346 | 3/2005 |
| JP | A-2006-168709 | 6/2006 |
| JP | A-2006-327452 | 12/2006 |

* cited by examiner

OBSTACLE DEFLECTOR OF RAILCAR

TECHNICAL FIELD

The present invention relates to an obstacle deflector provided at a front portion of an underframe of a carbody of a railcar.

BACKGROUND ART

Conventionally, to protect a carbody of a railcar from an obstacle on a railway track while the railcar is traveling at high speed, an obstacle deflector is being attached to a front portion of an underframe of a carbody of a first car of the railcar. A typical obstacle deflector includes an obstacle deflecting plate having a curved shape that is convex toward a front side in a traveling direction in plan view, and the obstacle deflecting plate is configured to receive the obstacle (see Japanese Laid-Open Patent Application Publication No. 2005-53346, for example).

SUMMARY OF INVENTION

Technical Problem

Since the railcars are increasing in speed in recent years, the crash energy generated when the obstacle crashes with the railcar tends to increase. Therefore, when designing an obstacle deflector, the crashworthiness of the obstacle deflector needs to be improved for the purpose of absorbing a large amount of crash energy.

A railcar described in Japanese Laid-Open Patent Application Publication No. 2006-168709 is provided with a buffer device including a plurality of plate springs provided behind an obstacle deflecting plate. With this, the crash energy can be adequately absorbed by the buffer device. However, since both the obstacle deflecting plate and the buffer device are provided, the device weight significantly increases. Regarding high-speed railcars, there is a strong demand for weight reduction, so that the structure of not increasing the weight is desired.

Here, an object of the present invention is to provide an obstacle deflector of a railcar, which is improved in an absorption energy per unit weight at the time of crash, is light in weight, and realizes efficient energy absorption.

Solution to Problem

An obstacle deflector of a railcar according to the present invention is an obstacle deflector provided at a front portion of an underframe of a carbody of a railcar, the obstacle deflector including an obstacle deflecting plate configured to protect the carbody from an obstacle on a railway track when the railcar is traveling, wherein: the obstacle deflecting plate includes a main plate portion provided to receive the obstacle by a surface thereof and having a curved shape that is convex toward a front side in a traveling direction in plan view and a sub plate portion projecting toward a rear side from the main plate portion; and the sub plate portion is continuously provided along the main plate portion so as to extend from a convex, curved front end portion of the main plate portion toward a pair of left and right side portions of the main plate portion, the left and right side portions being located at the rear side in the traveling direction.

According to the above configuration, in a case where the obstacle on the railway track crashes with the surface of the main plate portion of the obstacle deflecting plate, the sub plate portion suppresses the deformation of the main plate portion. Therefore, the stiffness of the obstacle deflecting plate can be increased without increasing the weight of the obstacle deflector. On this account, the absorption energy per unit weight at the time of the crash increases, and the efficient energy absorption can be realized while realizing the light weight.

DESCRIPTION OF EMBODIMENTS

Hereinafter, an embodiment of the present invention will be explained in reference to the drawings.

Figure 1:
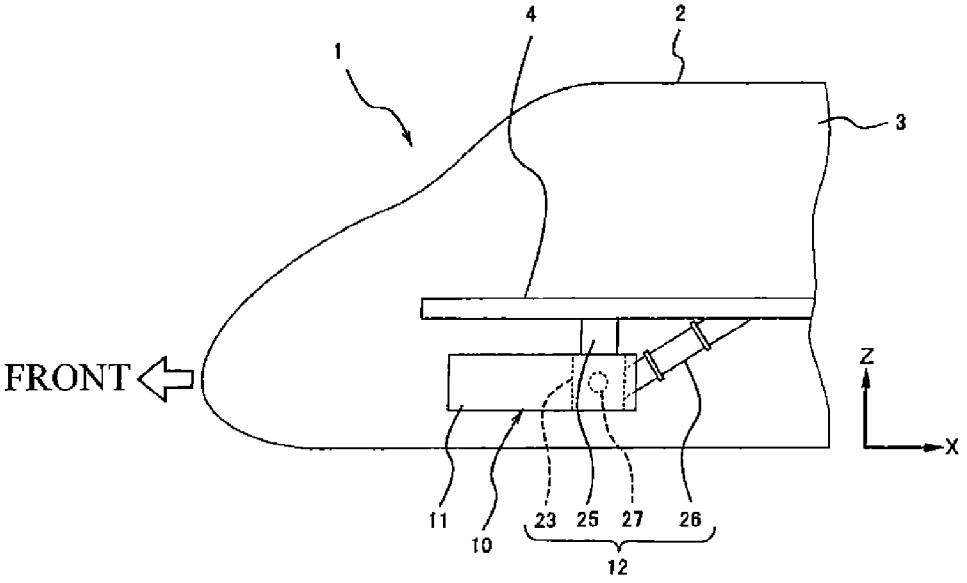
FIG. 1 is a left side view showing a state where an obstacle deflector according to an embodiment of the present invention is attached to a railcar.

FIG. 1 is a left side view showing a state where an obstacle deflector 10 according to the embodiment of the present invention is attached to a railcar 1. As shown in FIG. 1, the obstacle deflector 10 configured to protect from an obstacle on a railway track a carbody 3 of a first car 2 of the railcar 1 that travels at high speed is attached to a lower front portion of an underframe 4 of the carbody 3. The obstacle deflector 10 includes an obstacle deflecting plate 11 configured to protect the carbody from the obstacle and a supporting device 12 configured to couple the obstacle deflecting plate 11 to the underframe 4.

Figure 2:
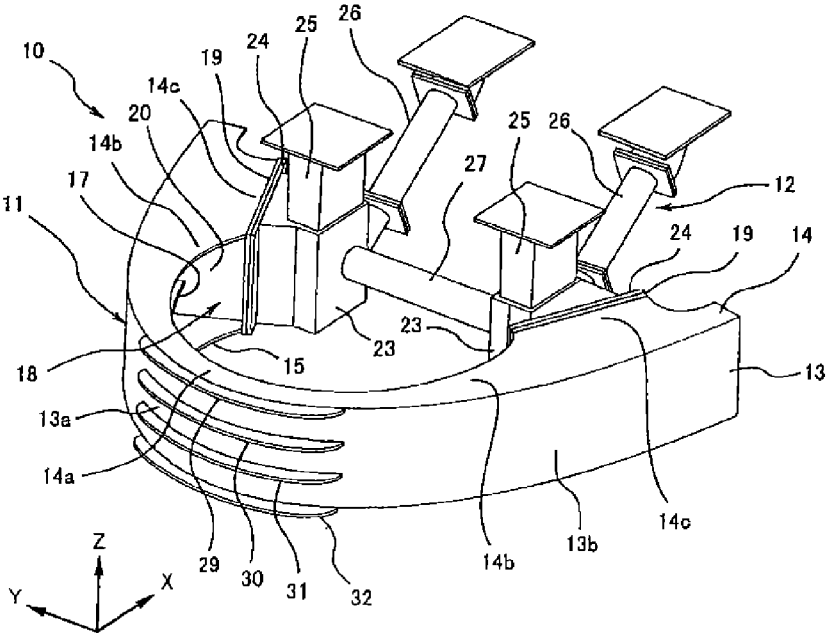
FIG. 2 is a perspective view of the obstacle deflector according to the embodiment of the present invention when viewed from a diagonally forward upper left side.
Figure 3:
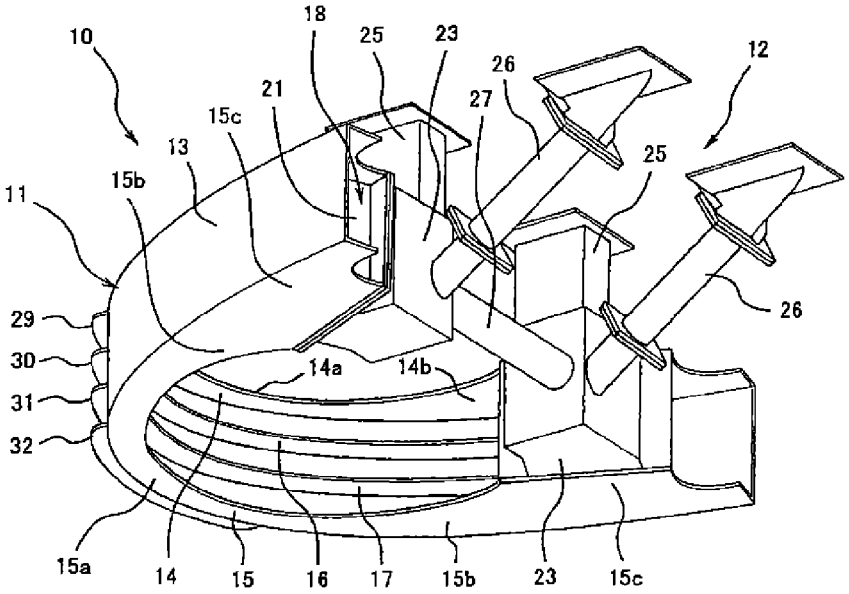
FIG. 3 is a perspective view of the obstacle deflector shown in FIG. 2 when viewed from a diagonally backward lower left side.
Figure 4:
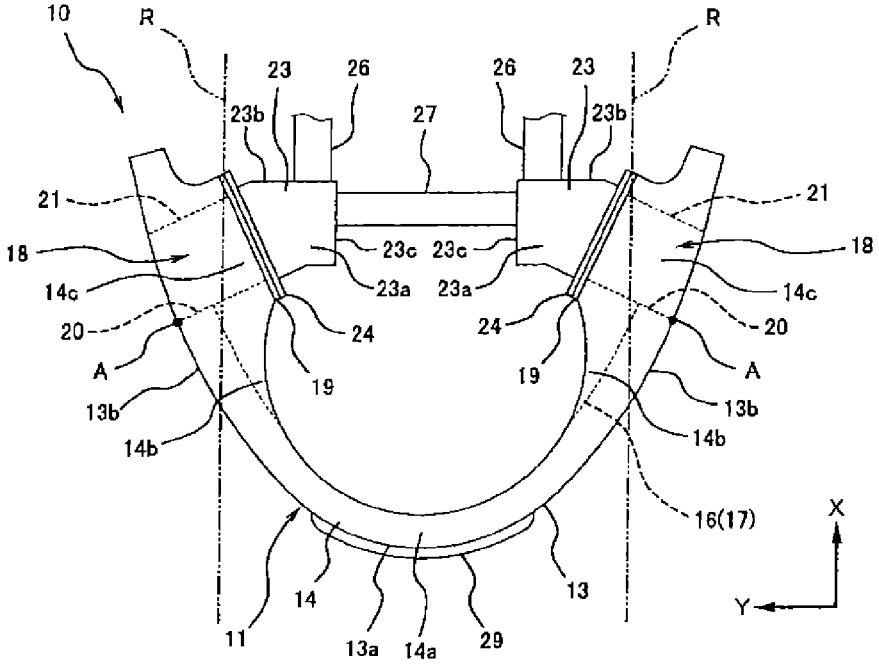
FIG. 4 is a plan view of the obstacle deflector shown in FIG. 2.

FIG. 2 is a perspective view of the obstacle deflector 10 according to the embodiment of the present invention when viewed from a diagonally forward upper left side. FIG. 3 is a perspective view of the obstacle deflector 10 shown in FIG. 2 when viewed from a diagonally backward lower left side. FIG. 4 is a plan view of the obstacle deflector 10 shown in FIG. 2. In the following explanation, a railcar traveling direction (front-rear direction) is denoted by X, a railcar width direction is denoted by Y, and a vertical direction is denoted by Z. As shown in FIGS. 2 to 4, the obstacle deflector 10 is made of a metal material, such as steel or aluminum alloy, to have a symmetrical shape. The obstacle deflecting plate 11 includes: a main plate portion 13 provided to receive the obstacle on a front side by its surface and having a circular-arc curved shape that is convex toward the front side in the traveling direction in plan view; an upper sub plate portion 14 projecting rearward from an upper end portion of the main plate portion 13; a lower sub plate portion 15 projecting rearward from a lower end portion of the main plate portion 13; and a plurality of (in the present embodiment, two) middle sub plate portions 16 and 17 projecting rearward from a vertically middle portion of the main plate portion 13 and provided to be spaced apart from each other in the vertical direction.

The main plate portion 13 includes: a front end portion 13*a* curved in a convex shape; and a pair of side portions 13*b* continuously extending from the front end portion 13*a* rearward in the traveling direction at both left and right sides of the front end portion 13*a*. The main plate portion 13 is provided such that a normal direction thereof substantially corresponds to a horizontal direction. In the present embodiment, in the entire length of the main plate portion 13 in the front-rear direction X, a portion corresponding to one third from the front end is the front end portion 13*a*, and a remaining portion corresponding to two third is the side portion 13*b*. A plurality of (in the present embodiment, four) plate-shaped anti-climbers 29 to 32 project forward from the front end portion 13*a* of the main plate portion 13 so as to be spaced apart from one another in an upper-lower direction.

Each of the upper sub plate portion 14 and the lower sub plate portion 15 is provided to continuously extend from the front end portion 13*a* of the main plate portion 13 to rear ends of a pair of left and right side portions 13*b*. The upper sub plate portion 14 and the lower sub plate portion 15 are respectively fixed to an upper end edge and lower end edge of the main plate portion 13 by, for example, welding. A projecting amount of a portion that is a part of the upper sub plate portion 14 and projects from the front end portion 13*a* of the main plate portion 13 and a projecting amount of a portion that is a part of the lower sub plate portion 15 and projects from the front end portion 13*a* of the main plate portion 13 are respectively smaller than a projecting amount of a portion that is a part of the upper sub plate portion 14 and projects from the side portion 13*b* of the main plate portion 13 and a projecting amount of a portion that is a part of the lower sub plate portion 15 and projects from the side portion 13*b* of the main plate portion 13. Specifically, the upper sub plate portion 14 includes a front constant region 14*a*, gradually increasing regions 14*b*, and rear constant regions 14*c*, and the lower sub plate portion 15 includes a front constant region 15*a*, gradually increasing regions 15*b*, and rear constant regions 15*c*. Each of the front constant regions 14*a* and 15*a* projects from the front end portion 13*a* of the main plate portion 13, and the projecting amount thereof is substantially constant. Each of the gradually increasing regions 14*b* and 15*b* projects from the side portion 13*b* of the main plate portion 13 so as to be smoothly continuous with the front constant region 14*a* or 15*a*, and the projecting amount thereof gradually increases as the gradually increasing region 14*b* or 15*b* extends rearward. Each of the rear constant regions 14*c* and 15*c* projects from the side portion 13*b* of the main plate portion 13 so as to be continuous with a rear side of the gradually increasing region 14*b* or 15*b*, and the projecting amount thereof is substantially constant.

In a direction along the main plate portion 13, the lengths of the front constant regions 14*a* and 15*a* are respectively larger than the lengths of the gradually increasing regions 14*b* and 15*b*. Each of the projecting amounts of the front constant regions 14*a* and 15*a* is smaller than a vertical width of the main plate portion 13. Each of the projecting amounts of the rear constant regions 14*c* and 15*c* and the maximum projecting amounts of the gradually increasing regions 14*b* and 15*b* is twice or more as large as each of the projecting amounts of the front constant regions 14*a* and 15*a*.

Each of the middle sub plate portions 16 and 17 is provided to continuously extend from the front end portion 13*a* of the main plate portion 13 to below-described box portions 18 and is fixed to a rear surface of the main plate portion 13 by, for example, welding. Each of the projecting amounts of the middle sub plate portions 16 and 17 is substantially the same as each of the projecting amounts of the front constant regions 14*a* and 15*a* of the upper sub plate portion 14 and the lower sub plate portion 15. Each of the sub plate portions 14 to 17 is provided such that a normal direction thereof substantially corresponds to the vertical direction. The sub plate portions 14 to 17 are provided at regular intervals in the upper-lower direction. The sub plate portions 14 to 17 and the anti-climbers 29 to 32 are provided to sandwich the main plate portion 13. In addition, the sub plate portions 14 to 17 are located at substantially the same heights as the anti-climbers 29 to 32, respectively.

The box portions 18 that are hollow hexahedrons are respectively provided at back surface sides (inner surface sides) of rear portions of the side portions 13*b* of the main plate portion 13. An upper surface and lower surface of each of the box portions 18 are respectively formed by the rear constant regions 14*c* and 15*c* of the upper sub plate portion 14 and the lower sub plate portion 15. An outer side surface of the box portion 18 is formed by the rear portion of the side portion 13*b* of the main plate portion 13. An inner side surface of the box portion 18 is formed by an inner plate member 19 joined by, for example, welding to projecting ends of the rear constant regions 14*c* and 15*c* of the upper sub plate portion 14 and the lower sub plate portion 15. A front surface and rear surface of the box portion 18 are respectively formed by a front plate member 20 and a rear plate member 21 that are joined by, for example, welding to a lower surface of the upper sub plate portion 14, an upper surface of the lower sub plate portion 15, and a back surface of the main plate portion 13. In the direction along the main plate portion 13, left and right end portions of each of the middle sub plate portions 16 and 17 respectively contact the front plate members 20 of the box portions 18. In plan view, an intersection point A of the front surface of the box portion 18 and the main plate portion 13, that is, the intersection point A of the front plate member 20 of the box portion 18 and the main plate portion 13 is located outside a railway track R in the railcar width direction.

The supporting device 12 is coupled to the main plate portion 13 via the box portions 18. The supporting device 12 is formed by a rigid body made of a metal, such as steel. The supporting device 12 is configured to couple the obstacle deflecting plate 11 to the underframe 4 (see FIG. 1). The supporting device 12 includes: first supporting members 25 configured to prevent the displacement of the obstacle deflecting plate 11 in the upper-lower direction; second supporting members 26 configured to prevent the displacement of the obstacle deflecting plate 11 in the front-rear direction; a third supporting member 27 configured to prevent the displacement of the obstacle deflecting plate 11 in the railcar width direction; and attaching members 23 used to attach the supporting members 25 to 27 to the box portions 18 of the obstacle deflecting plate 11. Attaching plates 24 are respectively fixed to sides of the attaching member 23 by, for example, welding, the sides being respectively opposed to the box portions 18. The attaching plates 24 are respectively fixed to the inner plate members 19 of the box portions 18 by bolts. In plan view, coupling surfaces where the obstacle deflecting plate 11 and the supporting device 12 are coupled to each other, that is, coupling surfaces at each of which the attaching plate 24 and the inner plate member 19 are coupled to each other are inclined so as to widen outward in the railcar width direction as they extend rearward.

Specifically, each of the attaching members 23 includes: an upper surface 23*a* that is a horizontal surface; a back surface 23*b* that is a vertical surface whose normal direction extends rearward in the traveling direction; and an inner surface 23*c* that is a vertical surface formed at right angle to the back surface 23*b*. Each of the first supporting members 25 extends upward in a state where a lower end thereof is fixed to the upper surface 23*a* of the attaching member 23. The other end of the first supporting member 25 is attached to a lower portion of the underframe 4 (see FIG. 1). Each of the second supporting members 26 extends to a diagonally backward upper side in a state where a front end thereof is fixed to the back surface 23*b* of the attaching member 23. The other end of the second supporting member 26 is attached to the lower portion of the underframe 4 (see FIG. 1). The third supporting member 27 is horizontally attached so as to couple the opposing inner surfaces 23*c* of the left and right attaching members 23. The displacement of the obstacle deflecting plate 11 in respective directions can be prevented by the supporting device 12 configured as above.

According to the configuration explained as above, in a case where the obstacle on the railway track crashes with a front surface of the main plate portion 13 of the obstacle deflecting plate 11, the sub plate portions 14 to 17 suppress the deformation of the main plate portion 13. Therefore, the stiffness of the obstacle deflecting plate 11 can be increased without increasing the weight of the obstacle deflector 10. In addition, since the main plate portion 13, the upper sub plate portion 14, and the lower sub plate portion 15 form a vertical cross-sectional shape that is convex toward the front side, the stiffness of the obstacle deflecting plate 11 can be effectively increased. Further, since the middle sub plate portions 16 and 17 also suppress the deformation of the main plate portion 13, the stiffness of the obstacle deflecting plate 11 when the obstacle crashes with the vertically middle portion of the main plate portion 13 can be more effectively increased. Therefore, the absorption energy per unit weight at the time of the crash increases, and the efficient energy absorption can be realized while realizing the light weight.

Since the upper sub plate portion 14 and the lower sub plate portion 15 are respectively provided with the gradually increasing regions 14*b* and 15*b*, the strengths of portions, close to the supporting device 12, of the upper sub plate portion 14 and the lower sub plate portion 15 increase. Therefore, the stiffness of the obstacle deflecting plate 11 can be further increased. Since the strengths of the portions, close to the supporting device 12, of the upper sub plate portion 14 and the lower sub plate portion 15 increase, the main plate portion 13 can be prevented from deforming intensively at a portion close to the supporting device 12, and a crash energy absorption performance by the front end portion 13*a* of the main plate portion 13 can be improved.

In addition, in the upper sub plate portion 14 and the lower sub plate portion 15, in the direction along the main plate portion 13 in plan view, the constant regions 14*a* and 15*a* are respectively longer than the gradually increasing regions 14*b* and 15*b*. Therefore, an initial load when the obstacle crashes with the front end portion 13*a* of the main plate portion 13 is prevented from becoming excessive, and the impact transmitted to the carbody 3 can be reduced. Therefore, both the crash energy absorption performance and an impact reducing performance can be suitably realized.

The strengths of portions, close to the supporting device 12, of the obstacle deflecting plate 11 are increased by the box portions 18. Therefore, even when the obstacle crashes with the main plate portion 13, and the front end portion 13*a* greatly deforms, the front end portion of the obstacle deflecting plate 11 can be prevented from twisting so as to bend downward, and the deformed front end portion of the obstacle deflecting plate 11 can be prevented from interfering with ground. Further, since each of the box portions 18 is formed by utilizing a part of the main plate portion 13, a part of the upper sub plate portion 14, and a part of the lower sub plate portion 15, the number of parts and the device weight can be reduced.

Left and right end portions of each of the middle sub plate portions 16 and 17 are restricted by the front plate members 20 of the box portions 18. Therefore, when the obstacle crashes with the main plate portion 13, the middle sub plate portions 16 and 17 deform. With this, the crash energy can be absorbed more effectively. Further, in the obstacle deflecting plate 11, since the portion of the intersection point A having high strength is located outside the railway track R in the railcar width direction, the portion of the intersection point A is located at an adequately rear side of the obstacle deflecting plate 11, so that the impact on the carbody can be adequately absorbed by the portion located at a front side of the intersection point A. Moreover, a plurality of anti-climbers 29 to 32 are provided on a front surface of the front end portion 13*a* of the main plate portion 13. Therefore, when the obstacle crashes with the obstacle deflecting plate 11 from the front, the obstacle can be prevented from getting on the obstacle deflecting plate 11.

In the main plate portion 13, a portion extending from the front end to the portion (box portion 18) coupled to the supporting device 12 is not supported by the carbody, and the front-rear-direction size of the portion that deforms at the time of the crash is set to an adequate size. Therefore, an adequate deformation stroke can be obtained even in a case where the railcars crash with each other. In addition, the obstacle deflector 10 can be easily attached to the carbody.

In the above embodiment, the box portions 18 are the hollow hexahedrons. However, an absorber may be accommodated in each box portion 18. In addition, in the above embodiment, in the direction along the main plate portion 13, the left and right end portions of each of the middle sub plate portions 16 and 17 respectively contact the front plate members 20 of the box portions 18. However, the left and right end portions of each of the middle sub plate portions 16 and 17 may be respectively fixed to the front plate members 20 of the box portions 18 by, for example, welding. The present invention is not limited to the above-described embodiment. Modifications, additions, and eliminations may be made within the spirit of the present invention.

Next, an analytical result in a case where the obstacle is caused to crash with the obstacle deflector 10 by computer simulation using Finite Element Analysis will be explained in reference to FIGS. 5A to 11. Analysis conditions (1) to (4) are as follows.

(1) Analytical Model

Figure 5A:
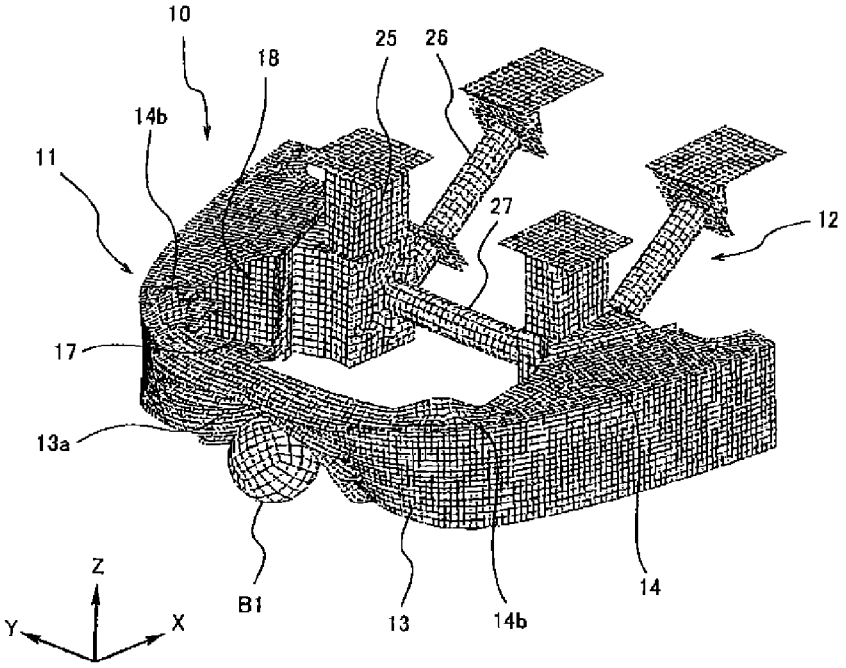
FIG. 5A is a perspective view showing a state where in Finite Element Analysis, a hard sphere of 100 kg crashes with a center of the obstacle deflector from a front side at 350 km/h
Figure 5B:
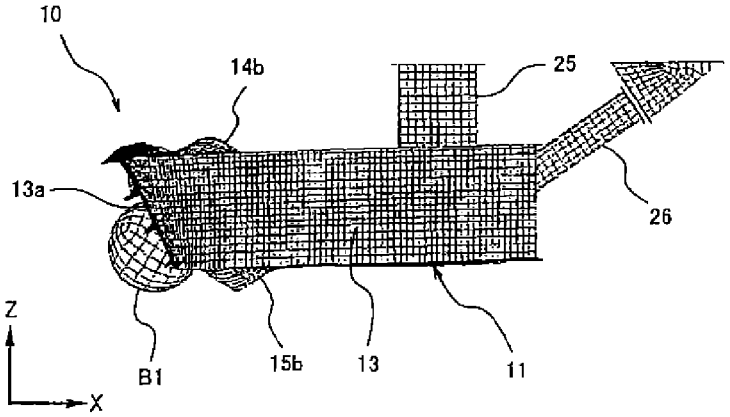
FIG. 5B is a side view showing the state.

Mesh finite element model of the obstacle deflector 10 having the shape shown in FIG. 2 (see FIGS. 5A and 5B)

(2) Material Physical Property Values

Table 1 shows the material physical property values used in the analysis, and Table 2 shows allowable stresses (MPa). SS400 was used for the obstacle deflecting plate 11, A5083-O was used for the attaching member 23 and the first supporting member 25, and A6N01-T5 was used for the second supporting member 26 and the third supporting member 27.

TABLE 1

| Quality of material | Young's modulus (MPa) | Poisson's ratio | Mass density (ton/mm$^3$) |
|---|---|---|---|
| SS400 | 205800. | 0.30 | $7.85 * 10^{-9}$ |
| A6N01-T5 | 70000. | 0.33 | $2.70 * 10^{-9}$ |
| A5083-O | 70000 | 0.33 | $2.70 * 10^{-9}$ |

TABLE 2

| Quality of material | Proof stress | Tensile strength |
|---|---|---|
| SS400 | 245 | 400 |
| A6N01-T5 (t < 6) | 205 | 245 |
| ↑ (6 < t < 12) | 175 | 225 |
| A5083-O | 125 | 275 |

(3) Analysis Solver

Analysis code: LS-DYNA Ver.971 (Livermore Software Technology Corporation)

Single Precision Version, Explicit Method (Crash Analysis)

(4) Analysis Conditions

Table 3 shows analysis cases.

TABLE 3

| | Analysis details | Load position |
|---|---|---|
| Case 1 (FIGS. 5A, 5B, and 6) | Hard sphere of 100 kg crashes with obstacle deflecting plate at 350 km/h. | Center |
| Case 2 (FIGS. 7A, 7B, and 8) | Hard sphere of 100 kg crashes with obstacle deflecting plate at 350 km/h. | Side surface |
| Case 3 (FIGS. 9A to 11) | Hard wall is pushed into obstacle deflecting plate at 36 km/h. | Center |

Figure 6:
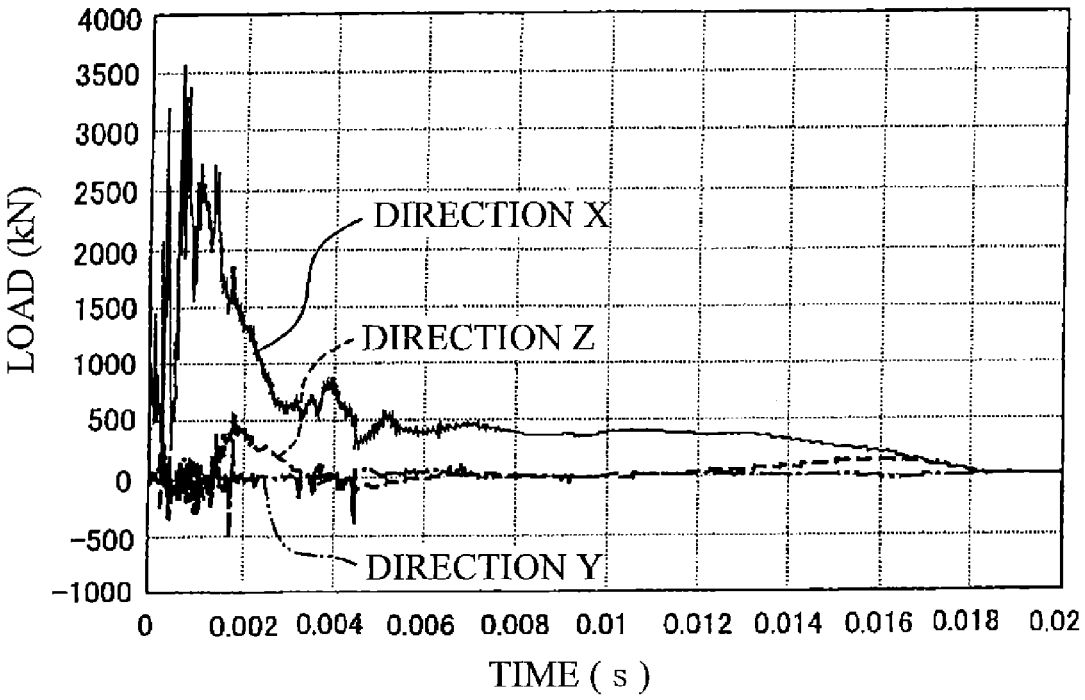
FIG. 6 is a graph showing temporal changes of loads acting on a carbody in the case of FIG. 5.

FIG. 5A is a perspective view showing a state where in Finite Element Analysis, a hard sphere B1 of 100 kg crashes with a center of the obstacle deflector 10 from the front at 350 km/h, and FIG. 5B is a side view showing the state. FIG. 6 is a graph showing temporal changes of loads acting on the carbody in the case of FIGS. 5A and 5B. As shown in FIGS. 5A, 5B, and 6, in a case where the hard sphere B1 crashed with the front end portion 13*a* of the main plate portion 13 of the obstacle deflecting plate 11, the deformation of the main plate portion 13 was suppressed by the sub plate portions 14 to 17. Therefore, the initial load in the direction X was high to some extent. Since the projecting amounts of the constant regions 14*a* and 15*a* that are the front end portions of the upper sub plate portion 14 and the lower sub plate portion 15 were small, the initial load when the hard sphere B1 crashed with the front end portion 13*a* of the main plate portion 13 was prevented from becoming too high. Therefore, it was confirmed that the crash energy was successfully absorbed while preventing the impact transmitted to the carbody 3 from becoming excessive.

The upper sub plate portion 14 and the lower sub plate portion 15 were respectively provided with the gradually increasing regions 14*b* and 15*b*. By the deformation suppressing effect by the gradually increasing regions 14*b* and 15*b*, the main plate portion 13 was prevented from deforming intensively at the portion close to the supporting device 12. Therefore, it was confirmed that the load transmitted to the carbody was successfully prevented from greatly varying with time. In addition, the strengths of the portions, close to the supporting device 12, of the obstacle deflecting plate 11 were increased by the box portion 18. Therefore, even when the hard sphere B1 crashed with the main plate portion 13, and the front end portion 13*a* greatly deformed, the front end portion of the obstacle deflecting plate 11 was prevented from twisting so as to bend downward. On this account, it was confirmed that the deformed front end portion of the obstacle deflecting plate 11 was successfully prevented from interfering with the ground.

Figure 7A:
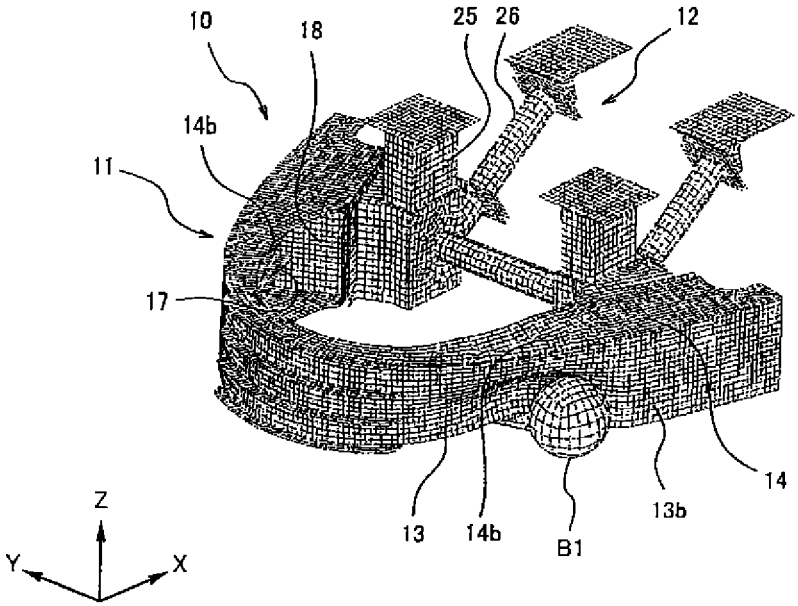
FIG. 7A is a perspective view showing a state where in Finite Element Analysis, the hard sphere of 100 kg crashes with a side surface of the obstacle deflector from the front side at 350 km/h.
Figure 7B:
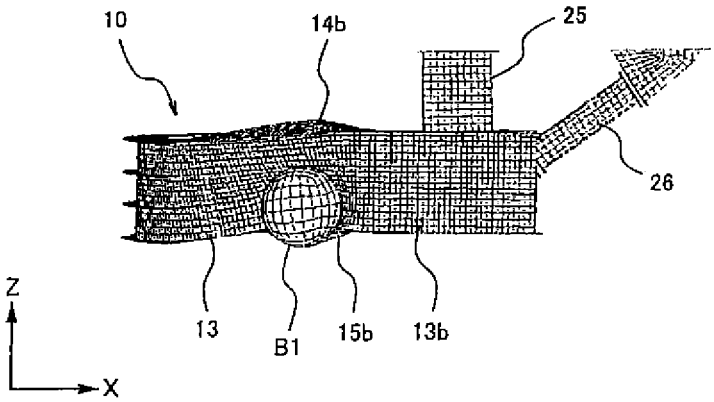
FIG. 7B is a side view showing the state.
Figure 8:
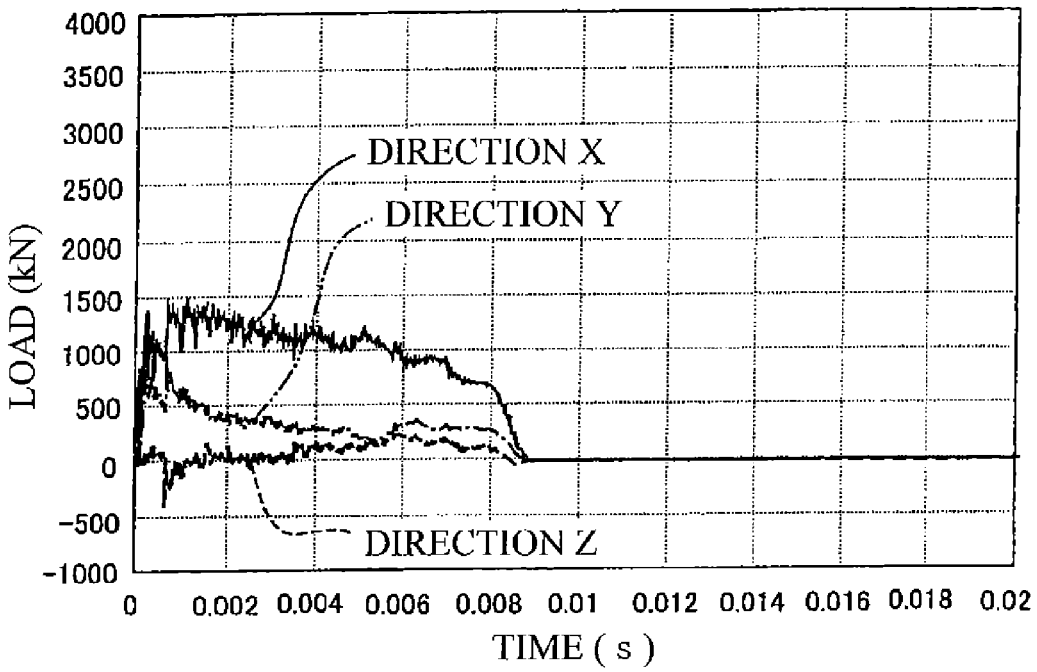
FIG. 8 is a graph showing temporal changes of loads acting on the carbody in the case of FIG. 7.

FIG. 7A is a perspective view showing a state where in Finite Element Analysis, the hard sphere of 100 kg crashes with the side surface of the obstacle deflector from the front at 350 km/h, and FIG. 713 is a side view showing the state. FIG. 8 is a graph showing temporal changes of the loads acting on the carbody in the case of FIG. 7A. As shown in FIGS. 7A, 7B, and 8, in a case where the hard sphere B1 crashed with the side portion 13*b* of the main plate portion 13 of the obstacle deflecting plate 11, both the initial load in the direction X and the initial load in the direction Y were high. It was confirmed that each of the peak value of the initial load in the direction X and the peak value of the initial load in the direction Y shown in FIG. 8 was smaller than the peak value of the initial load in the direction X shown in FIG. 6, but those loads acted for a long period of time, and the crash energy was adequately absorbed. In addition, as with FIG. 6, it was confirmed that: the main plate portion 13 was prevented from deforming intensively at the portion close to the supporting device 12; the load transmitted to the carbody was successfully prevented from greatly varying with time; and the deformed front end portion of the obstacle deflecting plate 11 was successfully prevented from interfering with the ground.

Figure 9A:
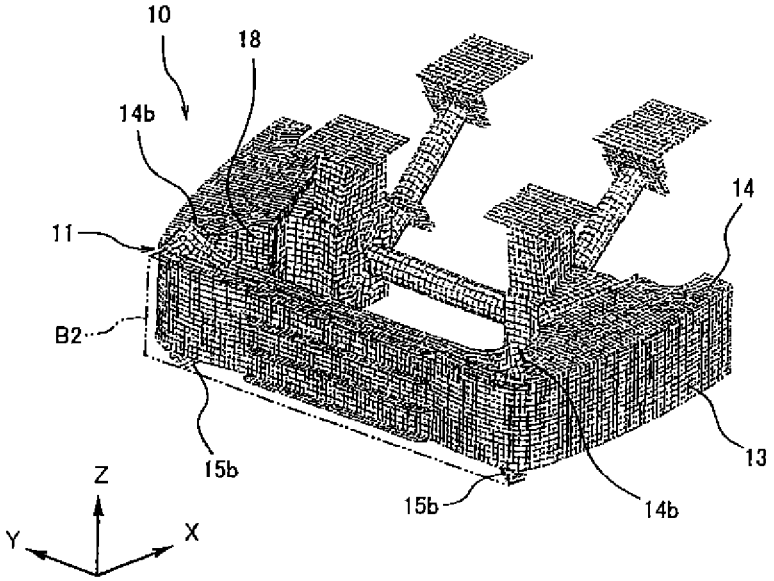
FIG. 9A is a perspective view showing a state where in Finite Element Analysis, a hard wall is pushed into an obstacle deflecting plate of the obstacle deflector at 36 km/h, and a pushed amount is 500 mm.
Figure 9B:
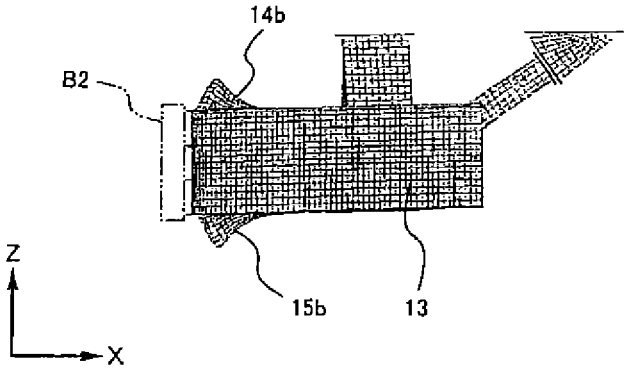
FIG. 9B is a side view showing the state.
Figure 10A:
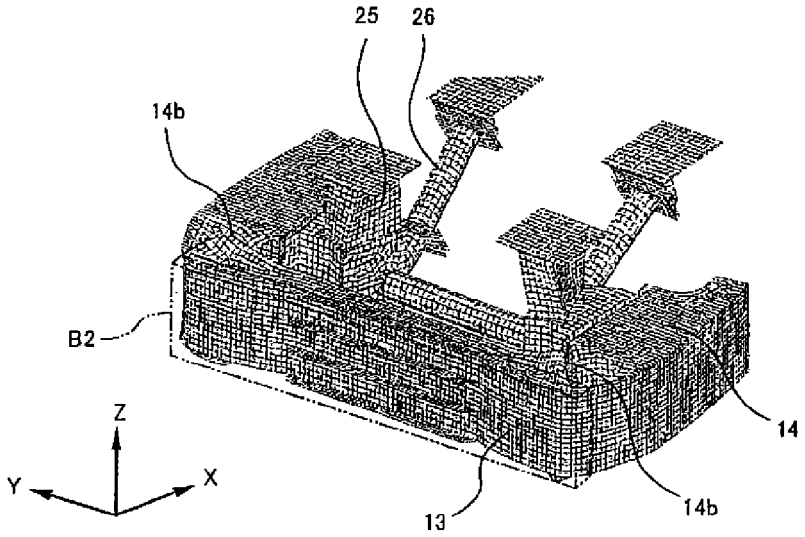
FIG. 10A is a perspective view showing a state where the obstacle deflecting plate is further pushed from the state shown in FIG. 9A, and the pushed amount is 700 mm.
Figure 10B:
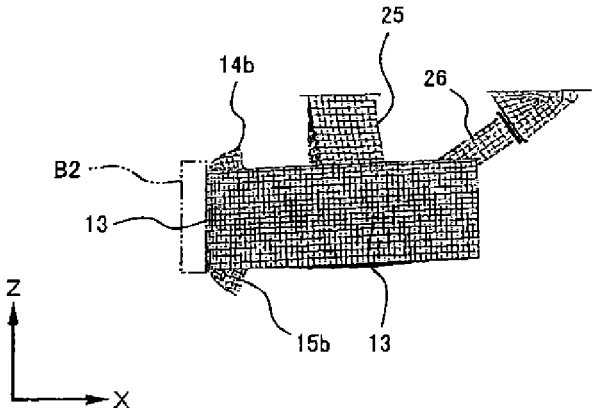
FIG. 10B is a side view showing the state.
Figure 11:
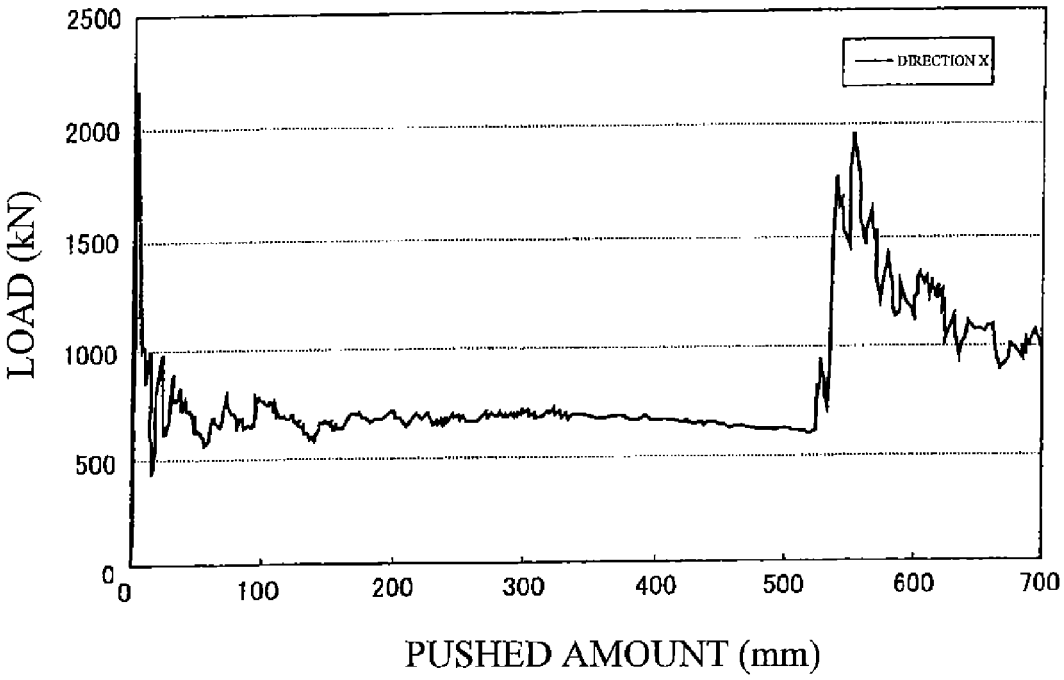
FIG. 11 is a graph showing a relation between the load acting on the carbody and the pushed amount in FIGS. 9A, 9B, 10A, and 10B.

FIG. 9A is a perspective view showing a state where in Finite Element Analysis, a hard wall B2 is pushed into the obstacle deflecting plate 11 of the obstacle deflector 10 at 36 km/h, and a pushed amount is 500 mm, and FIG. 9B is a side view showing the state. FIG. 10A is a perspective view showing a state where the obstacle deflecting plate 11 is further pushed from the state shown in FIG. 9, and the pushed amount is 700 mm, and FIG. 10B is a side view showing the state. FIG. 11 is a graph showing a relation between the load acting on the carbody and the pushed amount in FIGS. 9A, 9B, 10A, and 10B. As shown in FIGS. 9A to 11, it was confirmed that in a case where the hard wall B2 whose length in the railcar width direction was substantially the same as that of the obstacle deflecting plate 11 was pushed into the main plate portion 13, the initial load in the direction X became high, and after that, while the pushed amount was increasing, the load acted, and the crash energy was absorbed. Then, when the pushed amount exceeded 500 mm, the gradually increasing regions 14*b* and 15*b* of the upper sub plate portion 14 and the lower sub plate portion 15 greatly buckled so as to become wavy, and this again increased the load. With this, it was confirmed that the crash energy was successfully absorbed not only at an initial stage of the crash but also at a later stage of the crash.

The invention claimed is:

1. An obstacle deflector provided at a front portion of an underframe of a carbody of a railcar, the obstacle deflector comprising:

an obstacle deflecting plate configured to protect the carbody from an obstacle on a railway track when the railcar is traveling; and a supporting device wherein:

the obstacle deflecting plate includes a main plate portion provided to receive the obstacle by a surface thereof and having a curved shape that is convex toward a front side in a traveling direction in plan view and a sub plate portion projecting toward a rear side from the main plate portion;

the sub plate portion is continuously provided along the main plate portion so as to extend from a convex, curved front end portion of the main plate portion toward a pair of left and right side portions of the main plate portion, the left and right side portions being located at the rear side in the traveling direction;

the supporting device is configured to couple the side portions of the obstacle deflecting plate to the underframe; and the sub plate portion includes gradually increasing regions at portions projecting from the side portions, and projecting amounts of the gradually increasing regions gradually increase as the gradually increasing regions extend from the front end portion to the supporting device.

2. The obstacle deflector according to claim 1, wherein:

the sub plate portion includes a constant region including a portion projecting from the front end portion, smoothly continuous with the gradually increasing regions, and having a substantially constant projecting amount; and in a direction along the main plate portion in plan view, the constant region is larger in length than each of the gradually increasing regions.

3. The obstacle deflector according to claim 1, wherein the sub plate portion includes an upper sub plate portion projecting toward the rear side from an upper end portion of the main plate portion and a lower sub plate portion projecting toward the rear side from a lower end portion of the main plate portion.

4. The obstacle deflector according to claim 1, wherein the sub plate portion includes a middle sub plate portion projecting toward the rear side from a vertically middle portion of the main plate portion.

5. The obstacle deflector according to claim 1, comprising a supporting device configured to couple the side portions of the obstacle deflecting plate to the underframe, wherein the main plate portion and the supporting device are coupled to each other via box portions.

6. The obstacle deflector according to claim 5, wherein:

the sub plate portion includes an upper sub plate portion projecting toward the rear side from an upper end portion of the main plate portion and a lower sub plate portion projecting toward the rear side from a lower end portion of the main plate portion;

an upper surface and lower surface of each of the box portions are respectively formed by a part of the upper sub plate portion and a part of the lower sub plate portion;

an outer side surface of each of the box portions is formed by a part of the main plate portion;

an inner side surface of each of the box portions is formed by an inner plate member joined to a projecting end of the upper sub plate portion and a projecting end of the lower sub plate portion; and a front surface and rear surface of each of the box portions are respectively formed by a front plate member and a rear plate member, each of whose end edges are joined to a lower surface of the upper sub plate portion, an upper surface of the lower sub plate portion, and a back surface of the main plate portion.

7. The obstacle deflector according to claim 5, wherein in plan view, an intersection point of the main plate portion and each of front surfaces of the box portions is located outside a railway track in a left-right direction.

8. The obstacle deflector according to claim 5, wherein:

the sub plate portion includes a middle sub plate portion projecting to the rear side from a vertically middle portion of the main plate portion; and in a direction along the main plate portion, left and right end portions of the middle sub plate portion respectively contact the box portions.

9. The obstacle deflector according to claim 1, comprising a plate-shaped anti-climber projecting toward the front side from the main plate portion.

* * * * *